US008802340B2

(12) United States Patent
Nakamura et al.

(10) Patent No.: US 8,802,340 B2
(45) Date of Patent: Aug. 12, 2014

(54) ELECTROPHOTOGRAPHIC TONER, DEVELOPER FOR ELECTROPHOTOGRAPHY USING THE TONER, PROCESS CARTRIDGE, AND IMAGE FORMING APPARATUS USING THE SAME

(75) Inventors: Yasushige Nakamura, Kanagawa (JP); Shinichi Yaoi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1742 days.

(21) Appl. No.: 12/170,304

(22) Filed: Jul. 9, 2008

(65) Prior Publication Data

US 2009/0162771 A1 Jun. 25, 2009

(30) Foreign Application Priority Data

Dec. 25, 2007 (JP) ..... 2007-332960

(51) Int. Cl.
*G03G 9/16* (2006.01)
*G03G 9/087* (2006.01)
*G03G 9/08* (2006.01)

(52) U.S. Cl.
CPC .. *G03G 9/08753* (2013.01); *G03G 2215/00455* (2013.01); *G03G 9/08795* (2013.01); *G03G 9/08704* (2013.01); *G03G 9/08755* (2013.01); *G03G 9/0819* (2013.01); *G03G 9/08797* (2013.01)
USPC ..... 430/108.1; 430/108.2; 430/108.21; 430/108.23; 430/109.4

(58) Field of Classification Search
USPC ..... 430/108.21, 108.2, 108.23, 109.4
See application file for complete search history.

(56) References Cited

U.S. PATENT DOCUMENTS

| | | | | |
|---|---|---|---|---|
| 3,278,513 | A | 10/1966 | Jahrstorfer et al. | |
| 5,314,778 | A * | 5/1994 | Smith et al. | 430/108.22 |
| 6,210,852 | B1 | 4/2001 | Nakamura | |
| 2003/0190544 | A1 * | 10/2003 | Tanaka et al. | 430/108.23 |
| 2003/0232268 | A1 * | 12/2003 | Sacripante et al. | 430/137.14 |
| 2004/0142262 | A1 | 7/2004 | Nakamura et al. | |
| 2004/0142263 | A1 * | 7/2004 | Mikuriya et al. | 430/108.2 |

(Continued)

FOREIGN PATENT DOCUMENTS

| | | |
|---|---|---|
| EP | 0 978 766 A1 | 2/2000 |
| JP | A-5-224457 | 9/1993 |

(Continued)

OTHER PUBLICATIONS

English abstract and tanslation of JP 10268551 A, Oct. 1998, Yoshino et al.*

(Continued)

*Primary Examiner* — Mark F Huff
*Assistant Examiner* — Rashid Alam
(74) *Attorney, Agent, or Firm* — Oliff PLC

(57) ABSTRACT

The invention provides an electrophotographic toner having at least: a binder resin, a coloring agent, and an alkali metal salt of polyethylene oxide.

The invention further provides an electrophotographic developer having the electrophotographic toner, a process cartridge having a developer bearing body which accommodates the electrophotographic developer, and an image forming apparatus having a toner image forming member that forms a toner image on a recording medium by using the electrophotographic developer and a fixing member that fixes the toner image by heating and pressurizing or by photoirradiation. The processing speed in image formation using the image forming apparatus can be about 1,000 mm/sec or more.

13 Claims, 3 Drawing Sheets

(56) References Cited

U.S. PATENT DOCUMENTS

| | | | | |
|---|---|---|---|---|
| 2005/0226661 | A1* | 10/2005 | Ohmura et al. | 399/333 |
| 2007/0048651 | A1 | 3/2007 | Nakamura | |
| 2007/0141498 | A1* | 6/2007 | Umehara | 430/108.21 |
| 2007/0287089 | A1* | 12/2007 | Kimura et al. | 430/108.2 |
| 2008/0118855 | A1* | 5/2008 | Nakayama et al. | 430/109.4 |
| 2008/0171273 | A1* | 7/2008 | Cheong et al. | 430/48 |

FOREIGN PATENT DOCUMENTS

| | | |
|---|---|---|
| JP | A-7-209909 | 8/1995 |
| JP | 10268551 A * | 10/1998 |
| JP | A-2000-56500 | 2/2000 |
| JP | A-2000-66438 | 3/2000 |
| JP | A-2000-147829 | 5/2000 |
| JP | A-2000-284528 | 10/2000 |
| JP | A-2002-72538 | 3/2002 |
| JP | A-2004-138727 | 5/2004 |
| JP | A-2006-23322 | 1/2006 |
| JP | A-2007-57659 | 3/2007 |

OTHER PUBLICATIONS

Dec. 22, 2009 Office Action issued in Japanese Patent Application No. 2007-332960 (with translation).

Australian Office Action cited in Application No. 2008203394; mailed on Nov. 20, 2009.

* cited by examiner

ELECTROPHOTOGRAPHIC TONER, DEVELOPER FOR ELECTROPHOTOGRAPHY USING THE TONER, PROCESS CARTRIDGE, AND IMAGE FORMING APPARATUS USING THE SAME

CROSS-REFERENCE TO RELATED APPLICATION

This application claims priority under 35 USC 119 from Japanese Patent Application No. 2007-332960 filed Dec. 25, 2007.

BACKGROUND

1. Technical Field

The present invention relates to an electrophotographic toner, a developer for electrophotography using the electrophotographic toner, a process cartridge and an image forming apparatus.

2. Related Art

Methods of making visible image information by forming an electrostatic latent image, such as electrophotography, have been used in various fields. In electrophotography, an electrostatic latent image is formed on a surface of a photoreceptor in a charging step and a light-exposing step, the electrostatic latent image is developed with a toner-containing electrostatic latent image developer (hereinafter sometimes referred to as "developer"), and then the image is made visible via transferring and fixing.

For the purpose of printing newspapers and direct mail, electrophotographic printing machines capable of ultra high speed on-demand printing having a linear speed higher than 1,000 mm/sec have been examined in recent years with a view to replacing an offset press. In the field of electrophotographic systems, attempts have been made to increase actual printing volume by improving compatibility with broader paper and increasing speed.

A heat roll fixing system is generally used for a thermal fixing apparatus used in the fixing; however, an offset phenomenon in which a portion of toner is transferred onto a fixing roll upon fixing may occur in this system.

Known methods for fixing a toner image after transfer including fixing a toner image by fixing a toner by pressurization and/or heating followed by solidification, fixing a toner image by fixing a toner by irradiation with light energy followed by solidification, and the like. Among these, a flash fixing method, which utilizes light and is thus free from harmful effects caused by pressurization or heating, has been the subject of much attention.

The flash fixing method has the advantages of (1) less deterioration in image resolution (reproducibility) due to smears, dust or the like generated during fixing, since pressurization of a toner for fixing of the toner is not required and thus there is no necessity for contacting (pressurizing) the toner with a fixing roller or the like, (2) there is no need to heat with a heat source or the like, so printing can be carried out immediately after power activation, without waiting until a heat source (fixing roller or the like) is preheated after power activation to a desired temperature, (3) a toner image can be fixed regardless of the material and thickness of a recording paper, such as a paper with an adhesive, a preprinted sheet or a paper having varying thickness, and (4) even if a fixing device becomes jammed by a system failure, a recording paper does not deteriorated and is not ignited by heat from a heat source.

Flash fixing is a non-contact system and makes paper delivery easy, and is thus a technique suitable for an ultra high speed printer having a processing speed in which the linear speed is higher than about 1,000 mm/sec. In an ultra high speed printer, however, significant smears occur not only on paper but also on paper-contacting members. Accordingly, there is strong demand for resistance to smears (smear resistance).

SUMMARY

The invention provides an electrophotographic toner which has excellent resistance against smearing and blocking, a developer for electrophotography using the electrophotographic toner, a process cartridge and an image forming apparatus.

Namely, one aspect of one exemplary embodiment of the invention is an electrophotographic toner comprising: a binder resin, a coloring agent, and an alkali metal salt of polyethylene oxide.

One aspect of another exemplary embodiment of the invention is an electrophotographic developer comprising the electrophotographic toner.

One aspect of another exemplary embodiment of the invention is a process cartridge comprising a developer bearing body which accommodates the electrophotographic developer.

One aspect of still another exemplary embodiment of the invention is an image forming apparatus comprising: a toner image forming member that forms a toner image on a recording medium by using the electrophotographic developer of claim 15; and a fixing member that fixes the toner image by heating and pressurizing or by photoirradiation so that the toner image is fixed to the recording medium, the processing speed in image formation using the image forming apparatus being about 1,000 mm/sec or more.

DETAILED DESCRIPTION

Figure 1:
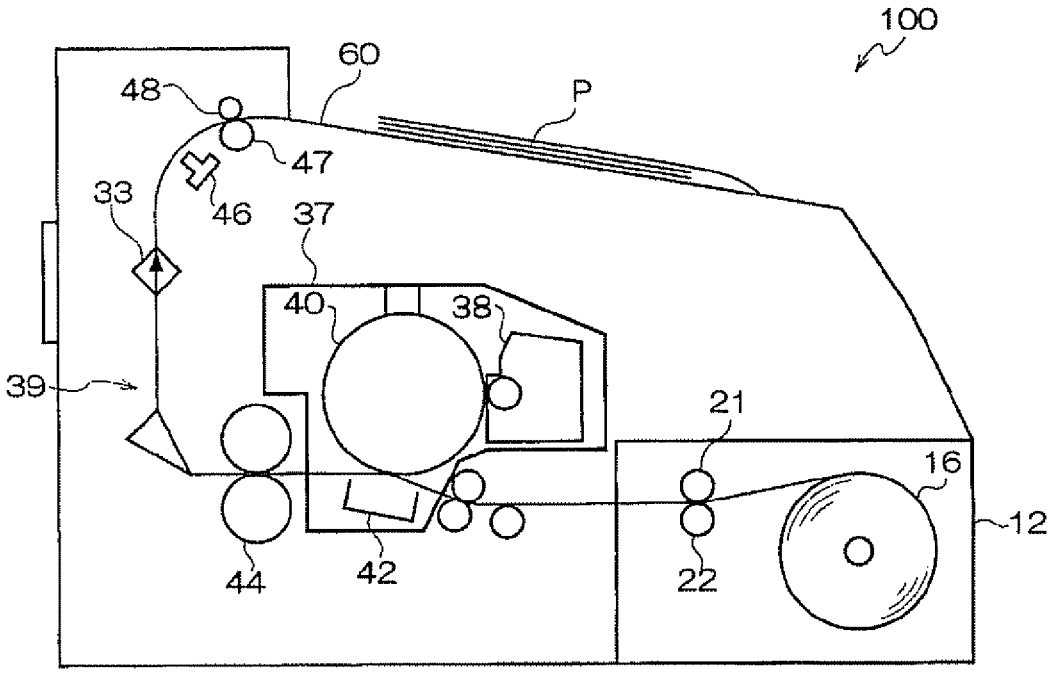
FIG. 1 is a schematic diagram illustrating an example of the image-forming apparatus according to one exemplary embodiment of the invention.

Hereinafter, the present invention will be described in detail.

Electrophotographic Toner

The electrophotographic toner of an aspect of one exemplary embodiment of the invention (hereinafter sometimes simply referred as a "toner") contains at least a binder resin, a coloring agent, and an alkali metal salt of polyethylene oxide.

When the processing speed in image formation is increased, particularly to about 1,000 mm/sec or more, there are concerns that smears may appear not only on papers but also between a paper and a member for post-treatment after fixing. When a wax such as polyethylene is mixed in a binder resin, smears are considered to occur particularly easily because the polyethylene is not uniformly dispersed in the resin so that large wax domains occur on the surface of a toner.

When a toner image is fixed by flash fixing, the toner is not pressed upon fixing, and thus a fixed image (toner) rises higher than in heat roll fixing, and thus easily falls away by rubbing with paper or the like, and therefore, smears may be more frequently caused.

As a result of extensive researches, the inventors found that the generation of the smear may be suppressed by using an alkali metal salt of polyethylene oxide as wax in a toner. While polyethylene oxide is sometimes used singly as wax for a toner, the inventors found that one kind of "ionomer (ionized polymer)" obtained by converting a carboxyl croup of polyethylene oxide with an alkali metal into a metal salt can be used to significantly improve dispersibility in the resin as compared with polyethylene or polyethylene oxide.

Examples of an ionomers which have been used as wax include one formed by ionomizing a cycloolefin binder resin itself with zinc. However, such ionomized waxes achieve little improvement in dispersibility in the resin. The effect may not be obtained at all even if a resin obtained by converting a polyolefin which is other than polyethylene into an ionomer is used.

As a result of further researches, the inventors found that the dispersibility of the polyethylene itself in the resin is also improved when polyethylene is simultaneously used as wax in a system in which the alkali metal salt of polyethylene oxide. This indicates that the alkali metal salt of polyethylene oxide not only improves the dispersibility of the alkali metal salt itself into the resin but also functions as a dispersing agent to improve the dispersibility of the polyethylene in the resin.

The electrophotographic toner of the exemplary embodiment is effective in respect of smear resistance and blocking resistance because the wax is present in a uniformly dispersed state on the toner surface (state free from extruded large wax domains) even if a part of the alkali metal salt of polyethylene oxide, which is used as the wax, and/or a part of the polyethylene is extruded from the surface of the toner surface after fixing. Specifically, a continuous form paper (roll paper), which is similar to that used in a printing machine, is sometimes used as a recording medium when a high speed machine with a linear speed of about 1,000 mm/sec. or higher is used. In such a case, the electrophotographic toner of the exemplary embodiment is particularly effective in reducing toner staining on processing members that is caused by post-treatment (such as cutting, enclosing and/or sealing a continuous paper after fixing of toner images) of a large amount of media having fixed images in a post-treatment machine.

Hereinafter, the electrophotographic toner of the exemplary embodiment is described in detail together with a method for manufacturing the same.

Alkali Metal Salt of Polyethylene Oxide

First, the alkali metal salt of polyethylene oxide used in the exemplary embodiment of one aspect of the invention is described.

Polyethylene Oxide

Polyethylene oxide (wax) is usually produced by melting polyethylene as a starting material and then introducing oxygen or an oxygen-containing gas into the melt starting material followed by oxidation reaction. Examples of known methods of producing such polyethylene oxide include those described in U.S. Pat. No. 3,278,513, German Patent Application Laid-Open (DE-A) No. 1227654, DE-A No. 2241057, and East German Patent (DD) No. 283730.

Examples of the starting polyethylene used in production of polyethylene oxide include a polyethylene obtained by pyrolysis of a high-molecular polyethylene, a polyethylene obtained by polymerization of free groups of ethylene in a high-pressure process, and a polyethylene obtained by homopolymerizing ethylene in the presence of a metal catalyst or by copolymerizing ethylene with α-olefin in the presence of a metal catalyst.

Examples of a metal catalyst which can be used in production of the starting polyethylene include a Ziegler catalyst and a metallocene catalyst.

The starting polyethylene used for forming the polyethylene oxide in the exemplary embodiment can be preferably a polyethylene having a weight-average molecular weight of in a range of about 600 to about 900, and can be more preferably in a range of about 700 to about 800.

When the weight-average molecular weight of the starting polyethylene is less than about 600, while the final metal salt can be excellent in dispersibility in the resin, blocking in the toner may be caused due to its low melting temperature and low-molecular weight. When the molecular weight of the starting polyethylene is more than about 900, excellent dispersibility in the resin and function as a dispersing agent may not be exhibited.

The weight-average molecular weight is determined by using GPC-15° C. (trade name, manufactured by Waters) as an apparatus, two columns GMH-HT (trade name, manufactured by Tosoh Corporation) and o-dichlorobenzene (containing 0.1% ionol) as an eluent. The experiment is carried under the following experimental conditions: the concentration of a sample is about 0.15% by mass; the flow rate is about 1.0 ml/min.; the volume of a sample injected is about 0.4 ml; the measurement temperature is about 135° C.; and the detector is an IR detector. A calibration curve is prepared using "POLYSTYRENE STANDARD SAMPLES TSK STANDARD" (trade name, manufactured by Tosoh Corporation) including 10 samples named "A-500", "F-1", "F-10", "F-80", "F-380", "A-2500", "F-4", "F-40", "F-128", and "F-700" respectively.

The molecular weights of various components described below are also measured in the same manner as described above.

The weight-average molecular weight of the alkali metal salt of polyethylene oxide described below is almost the same as that of the polyethylene used as the starting material. The molecular weight of the alkali metal salt of polyethylene oxide contained in the toner is in the range of about 600 to about 900.

Oxidation of the polyethylene can be carried out by contacting the polyethylene with oxygen or an oxygen-containing gas while the polyethylene is in a molten state under stirring. The temperature (reaction temperature) at the time of the melting is preferably in a range of about 140° C. to about 180° C., preferably in a range of about 150° C. to about 170° C.

The oxidization can be carried out at ordinary temperature or under pressure. The oxidization under pressure can be conducted at a pressure of about 0.5 MPa to about 0.8 MPa, preferably at a pressure of about 0.55 MPa to about 0.75 MPa.

Specific examples of the method of contacting the starting polyethylene with oxygen or an oxygen-containing gas include a method including continuously supplying oxygen or an oxygen-containing gas from the bottom of a reactor to the polyethylene.

The acid value of the resulting polyethylene oxide is preferably in a range of about 6 mg KOH/g to about 30 mg KOH/g, and is more preferably in a range of about 10 mg KOH/g to about 20 mg KOH/g.

The acid value is determined by a neutralization titration method which accords with a conventionally-known test methods for acid value, saponification value, ester value, iodine value, hydroxyl value and unsaponifilable matter of chemical products known as JIS K0070. That is, a suitable amount of a sample is collected, and 100 ml of a solvent (diethyl ether/ethanol mixture) and several drops of an indicator (phenolphthalein solution) are added to, and mixed with, the sample which is then sufficiently shaken until it is completely dissolved. The resulting solution is titrated with 0.1 mol/l potassium hydroxide solution in ethanol, and the point of time when the pale red of the indicator continues for 30 seconds is regarded as the end point. The acid value A is calculated from the following equation.

$$A=(B\times f\times 56.11)/S$$

In the equation, A is an acid value, S is the amount (g) of the sample, B is the amount (ml) of 0.1 mol/l potassium hydroxide solution in ethanol used in the titration, and f is the factor of 0.1 mol/l potassium hydroxide solution in ethanol.

When a carboxyl group in the sample has formed a salt structure ($—COO^-Y^+$ in which $Y^+$ is an alkali metal ion) described below, the acid value can be determined by converting the salt with an acid such as hydrochloric acid into the corresponding carboxylic acid and then subjecting the resulting acid to the titration.

Conversion of the polyethylene oxide into the corresponding alkali metal salt (ionomer) can be generally achieved by melt kneading the polyethylene oxide with a metal ion source by means of an extruder and then neutralizing carboxyl groups in the polyethylene oxide.

Specifically, the reaction can be conducted by feeding the polyethylene oxide and a metal compound to a screw extruder and kneading them at the temperature at which each polymer is melted. While the metal compound may be directly fed to a screw extruder, a master batch containing the polyethylene oxide as a base polymer is preferably used for allowing the reaction to proceed smoothly.

The ionization reaction may be conducted, for example, under conditions in which a temperature is in the range of from the melting temperature of the polyethylene oxide to about 300° C. and a residence time is about 60 seconds or more. The kind of the screw extruder is not limited as long as it has considerable kneading capability and can take the residence time. A screw extruder having a venting mechanism can be used for removing byproducts generated by the ionization reaction.

When the toner is produced by the melt kneading method, the ionization reaction may be carried out simultaneously with kneading by adding an alkali metal compound together with the polyethylene oxide at the time of melt kneading.

In the exemplary embodiment, an alkali metal compound is used as the metal compound. While lithium, sodium, potassium, rubidium, cesium and francium are known as the alkali metal, potassium is most preferable because it has good reactivity with carboxyl groups of the polyethylene oxide and because KOH used as the metal compound has smaller amount of impurities.

The metal in the alkali metal salt of polyethylene oxide can be identified by fluorescent X-ray analysis.

While it is difficult to accurately determine the degree of neutralization, it can be approximately estimated from a peak ratio in an infrared absorption spectrum of the alkali metal salt of polyethylene oxide. For example, when the objective alkali metal salt of polyethylene oxide is measured for its infrared spectral absorption in the range of from about 400 $cm^{-1}$ to about 4,000 $cm^{-1}$ by the KBr method, an absorption peak Ph attributable to a carboxylic acid-derived carbonyl group is generally observed in the vicinity of 1650 $cm^{-1}$ to 1850 $cm^{-1}$, and an absorption peak Pm attributable to a carboxylic acid metal salt is observed in the vicinity of 1350 $cm^{-1}$ to 1450 $cm^{-1}$ or in the vicinity of 1550 $cm^{-1}$ to 1700 $cm^{-1}$. Accordingly, the degree at which carboxyl groups in the polyethylene oxide are converted into the metal salt can be known from the intensity ratio (Pm/Ph) of the absorption peak Pm to the absorption peak Ph.

The amount of the alkali metal salt of polyethylene oxide contained in the toner is preferably in the range of about 0.5% by mass to about 10% by mass, and is more preferably in the range of about 1% by mass to about 3% by mass, with respect to the total amount of the toner. When the amount of the alkali metal salt is less than about 0.5% by mass, the proper effects of the alkali metal salt as wax, such as an ability to confer releasability and smoothness, may be hardly attainable. When the amount of the alkali metal salt is more than about 10% by mass, smear resistance may not be problematic, while blocking resistance in a particularly high speed machine having a linear speed of 1,000 mm/sec. or higher may be concerned because a temperature of the toner may become high by radiation heat from a motor or the like.

Binder Resin

A conventionally-known binder resin may be used as the binder resin in the exemplary embodiment. Examples of the major component in the binder resin include polyester and polyolefin. Examples thereof further include a copolymer of styrene-acrylic acid or methacrylic acid, polyvinyl chloride, phenol resins, acrylic resins, methacrylic resins, polyvinyl acetate, silicone resins, polyester resins, polyurethane, polyamide resins, furan resins, epoxy resins, xylene resins, polyvinyl butyral, terpene resins, chroman indene resins, petroleum resins and polyether polyol resins. These resins may be used singly or in combination of two or more thereof.

Among them, the polyester resin can be used from the viewpoints such as easiness in increasing decomposition temperature and the like.

The polyester resin that can be used in the exemplary embodiment is described in more detail. Examples of the acid component used in the polyester resin include terephthalic acid, isophthalic acid, orthophthalic acid, and anhydrides thereof among which terephthalic acid and isophthalic acid are preferable. These acid components may be used singly or in a mixture of two or more thereof. Other acid components may be additionally used in combination with the acid components as long as smell generated therefrom by flash fixing is not problematic. Examples of the additional acid components include maleic acid, fumaric acid, citraconic acid, itaconic acid, glutaconic acid, cyclohexanedicarboxylic acid, succinic acid, adipic acid, sebacic acid, azelaic acid and malonic acid, and also include alkyl- or alkenyl-succinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid or isododecenylsuccinic acid, and acid anhydrides and lower alkyl esters thereof as well as other divalent carboxylic acids. For crosslinking the polyester resin, carboxylic acid components of trivalent or more-valency may also be used as the additional acid components in a mixing manner. Examples of the trivalent or more carboxylic acid components can include 1,2,4-benzenetricarboxylic acid, 1,3,5-benzenetricarboxylic acid, other polycarboxylic acids, and anhydrides thereof.

About 80 mol % or more, preferably about 90 mol % or more, and still more preferably about 95 mol % or more of the alcohol component in such polyester resin may be an alkylene oxide adduct of bisphenol A. When the amount of alkylene oxide adduct of bisphenol A is less than about 80 mol %, the amount of monomers causing smell may become relatively large.

Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl) propane, and polyoxypropylene (6)-2,2-bis(4-hydroxyphenyl) propane. These compounds may be used singly or in a mixture of two or more thereof.

In the polyester resin used as the binder resin in the exemplary embodiment, another alcohol component may be additionally used in combination with the alcohol component. Examples of the additional alcohol component include diols such as ethylene glycol, diethylene glycol, triethylene glycol, 1,2-propylene glycol, 1,3-propylene glycol, 1,4-butane diol, neopentyl glycol, 1,4-butene diol, 1,5-pentane diol and 1,6-hexane diol, and other dihydric alcohols such as bisphenol A or hydrogenated bisphenol A.

An alcohol which has three or more hydroxyl groups may be also used as the additional alcohol component. Examples thereof include sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methyl propane triol, 2-methyl-1,2,4-butane triol, trimethylol ethane, trimethylol propane, and other alcohols having three or more hydroxyl groups.

An ordinarily-used esterification catalyst such as zinc oxide, stannous oxide, dibutyltin oxide, or dibutyltin dilaurate may be advantageously used in order to promote the reaction for synthesizing the polyester resin.

The Tg (glass transition temperature) of the binder resin used in the toner can be in the range of about 50° C. to about 80° C.

When the toner of the exemplary embodiment is used for flash fixing, the toner may contain, as the binder resin, two kinds of polyester resins which are different in softening temperature. Specifically, the toner may contain a polyester resin mixture which contains a nonlinear first polyester resin and a nonlinear second polyester resin at a mass ratio of nonlinear:linear of approximately 50:50 to approximately 5:95. Herein, the nonlinear first polyester resin contains about 1 parts by mass to about 25 parts by mass of chloroform insoluble matter and having a softening temperature (Tsp) of about 120° C. or higher to less than about 170° C., and the nonlinear second polyester resin has a Tsp of about 80° C. or higher to less than about 110° C.

The polyester resin mixture can be contained in the toner because flash fixing property of the toner at high speed processing can be particularly secured and the resistance against smearing can be also effectively improved.

The Tsp of the first and second polyester resins can be in the ranges by regulating the molecular weights, acid values and the like of the respective resins.

Coloring Agent

A coloring agent can be suitably selected and used in the toner in accordance with the color of the toner.

Examples of the coloring agent for the cyan toner include cyan pigments including C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180; C.I. Vat Cyan 1, 3, and 20, iron blue, cobalt blue, alkali blue lake, phthalocyanine blue, nonmetal phthalocyanine blue, partially chlorinated phthalocyanine blue, Fast Sky Blue, and Indanthren Blue BC; and cyan dyes including C.I. Solvent Cyan 79 and 162; and the like. Among them, C.I. Pigment Blue 15:3 is effective.

Examples of the coloring agents for magenta toner include magenta pigment such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19; magenta dyes such as C.I. Solvent Red 1, 3, 8, 23, 24, 25, 27, 30, 49, 81, 82, 83, 84, 100, 109, and 121, C.I. Disperse Red 9, C.I. Basic Red 1, 2, 9, 12, 13, 14, 15, 17, 18, 22, 23, 24, 27, 29, 32, 34, 35, 36, 37, 38, 39, and 40; Bengala, cadmium red, red lead, mercury sulfide, cadmium, Permanent Red 4R, Lithol Red, pyrazolone red, watching red, calcium salts, Lake Red D, Brilliant Carmine 6B, eosin lake, Rhodamine Lake B, alizarin lake, Brilliant Carmine 3B, and the like.

Examples of the coloring agents for yellow toner include yellow pigments such as C.I. Pigment Yellow 2, 3, 15, 16, 17, 97, 180, 185, and 139; and the like.

In addition, examples of the coloring agents for black toner include carbon black, activated carbon, titan black, magnetic powders, and non-magnetic powders containing Mn. In this regard, a black toner of the exemplary embodiment may be one that contains a mixture of yellow pigments, magenta pigments, cyan pigments, red pigments, green pigments, and/or blue pigments.

The addition amount of each of the coloring agents above can be in the range of about 2% by mass to about 20% by mass with respect to the total amount of the toner particle prepared after blending with a binder resin and the like.

Other Components

The toner for electrophotography of one exemplary embodiment of one aspect of the invention may further contain an antistatic agent or a wax as needed.

Examples of the waxes for use in the toner of one exemplary embodiment of one aspect of the invention include ester waxes, polyethylene, polypropylene, and copolymers of polypropylene and polypropylene; and additionally, polyglycerin waxes, microcrystalline waxes, paraffin waxes, carnauba waxes, sazol wax, montanic acid ester waxes, deacidified carnauba waxes, unsaturated fatty acids such as palmitic acid, stearic acid, montanic acid, brassidic acid, eleostearic acid, or vemolic acid; saturated alcohols such as stearyl alcohol, aralkyl alcohols, behenyl alcohol, carnaubyl alcohol, ceryl alcohol, mericyl alcohol, or long-chain alkyl alcohols having a further longer-chain alkyl group; polyhydric alcohols such as sorbitol; fatty amides such as linoleic amide, oleic amide, and lauric amide; saturated fatty acid bisamides such as methylene bisstearic amide, ethylene biscaprinic amide, ethylene bislauric amide, or hexamethylene bisstearic amide; unsaturated fatty amides such as ethylene bisoleic amide, hexamethylene bisoleic amide, N,N'-dioleyl adipic amide, or N,N'-dioleyl sebacic-amide; aromatic bisamides such as m-xylene bisstearic amide or N,N'-distearyl isophthalic amide; fatty acid metal salts (generally called metal soaps) such as calcium stearate, calcium laurate, zinc stearate, or magnesium stearate; aliphatic hydrocarbon waxes grafted with a vinyl monomer such as those of styrene, acrylic acid, or the like; partially esterified compounds prepared from a fatty acid and a polyhydric alcohol such as behenic acid monoglyceride; hydroxyl group-containing methyl ester compounds obtained by hydrogenation of a vegetable oil; and the like.

In the exemplary embodiment, these waxes can be used singly or in combination of two or more thereof. In the exemplary embodiment, polyethylene can be contained in the toner together with the alkali metal salt of polyethylene oxide. While polyethylene itself has an effect of improving fusing property such as smear resistance, a wax in a toner is required to be more uniformly dispersed in the binder resin when the toner is formed to be compatible with a high-speed machine having a linear speed of about 1,000 mm/sec. or higher, since imaged formed by the toner is subjected to rubbing between papers or rubbing with another member at significantly higher speed or frequency than it is used in a low-speed machine. The toner of the exemplary embodiment can improve the dispersibility of the polyethylene in the resin and can further increase smear resistance and blocking resistance in addition to an advantage to costs by incorporating, in addition to the alkali metal salt of polyethylene oxide, the polyethylene as a wax.

The polyethylene, that may be used in addition to the alkali metal salt of polyethylene oxide, may have a higher molecular weight than usual, in view of making the toner compatible with the high-speed machine and flash fixing. Specifically, the weight-average molecular weight of the polyethylene is preferably in a range of about 12,000 to about 100,000, and is more preferably in a range of about 20,000 to about 35,000.

When the weight-average molecular weight of the polyethylene is less than about 12,000, the toner may become poor in strength and may fall away upon being rubbed even when the polyethylene is dispersed uniformly in the resin. When the molecular weight of the polyethylene exceeds about 100,000, the polyethylene may be so hard that it is hardly dispersed in the toner, and may fail to endow the toner with a significant effect on smearing resistance.

The wax which is other than the polyethylene and can be used in combination with the alkali metal salt of polyethylene oxide may be a wax which shows an endothermic absorption peak at about 50° C. to about 90° C. in differential scanning calorimetry (DSC). When the peak temperature is lower than about 50° C., the toner may be blocked, while when the temperature is higher than about 90° C., the wax may not contribute to improvement in fusing property.

Due to the principle of measurement, DSC measurement may be carried out with increasing temperature by 10° C./min. from room temperature (25° C.) with a highly accurate differential scanning calorimeter of inner heat-system input power compensation type.

When the alkali metal salt of polyethylene oxide and the polyethylene and the like are simultaneously used in the toner, the amount of the polyethylene and the like contained in the toner is preferably in the range of about 0.5% by mass to about 7% by mass, and is more preferably in the range of about 2% by mass to about 4% by mass, with respect to the total amount of the toner. The mass ratio of the two (alkali metal salt of polyethylene oxide/polyethylene and the like) is preferably in the range of about 3/1 to about 0.5/7, more preferably in the range of about 2/1.5 to about 1/5.

The toner for electrophotography of one exemplary embodiment of one aspect of the invention may further contain an antistatic agent or a wax as needed.

Examples of the antistatic agents include known calixarenes, nigrosin dyes, quaternary ammonium salts, amino group-containing polymers, metal-containing azo dyes, salicylic acid complex compounds, phenol compounds, azo chromium compounds, azo zinc compounds, and the like. In addition, a magnetic toner containing a magnetic material such as iron powder, magnetite, ferrite, or the like may be used as the toner. In particular, a white magnetic powder (such as that manufactured by Nittetsu Mining Co., Ltd.) may be used for color toners.

In a case that the toner for electrophotography of one exemplary embodiment of one aspect of the invention is applied for flash fixing, the toner may further contain an infrared absorber together with the coloring agent. The infrared absorber may be a material having at least one or more strong light absorption peaks at a wavelength in the near-infrared region, i.e., in the range of about 800 nm to about 2,000 nm observed by measurement by a spectrophotometer or the like, and may be an organic or inorganic substance.

Any conventionally-known infrared absorbers can be used as the infrared absorber used in the toner of the exemplary embodiment. Specific examples of the additional infrared absorber include cyanine compounds, merocyanine compounds, benzene thiol metal complexes, mercaptophenol metal complexes, aromatic diamine metal complexes, nickel complex compounds, phthalocyanine compounds, anthraquinone compounds, naphthalocyanine compounds, chroconium compounds, aminium compounds, diimmonium compounds, and the like.

More specific examples of the infrared absorber include cyanine infrared absorbers (trade names: CTP-1, IRF-106 and IRF-107, manufactured by Fujifilm Corporation), cyanine compounds (trade names: CY-2, CY-4 and CY-9, manufactured by Nippon Kayaku Co. Ltd.), nickel metal complex-containing infrared absorbers (trade name: SIR-130 and SIR-132, manufactured by Mitsui Chemicals), bis(dithiobenzyl) nickel (trade name: MIR-101, manufactured by Midori Kagaku Co. Ltd.), nickel bis(1,2-bis(p-methoxy phenyl)-1,2-ethylenedithiolate) (trade name; MIR-102, manufactured by Midori Kagaku Co. Ltd.), tetra-n-butylammonium nickel bis (cis-1,2-diphenyl-1,2-ethylene dithiolate) (trade name: MIR-1011 manufactured by Midori Kagaku Co. Ltd.), tetra-n-butylammonium nickel bis(1,2-bis(p-methoxyphenyl)-1,2-ethylenedithiolate) (trade name: MIR-1021, manufactured by Midori Kagaku Co. Ltd.), tetra-n-butyl ammonium nickel bis(4-tert-1,2-butyl-1,2-dithiophenolate) (trade name: BBDT-NI, manufactured by Sumitomo Seika Chemicals Co.), a soluble phthalocyanine (trade name: TX-305A, manufactured by Nippon Shokubai Co., Ltd.), naphthalocyanine (trade name: SnNc FT-1, manufactured by Sanyo Color works Ltd.), inorganic materials (trade name. YTTERBIUM UU-HP, manufactured by Shin-Etsu Chemical), indium tin oxide (manufactured by Sumitomo Metal Industries, Ltd.), and the like. These compounds may be used in combination of two or more thereof.

The amount of the infrared absorbing agent contained in the toner is preferably in the range of about 0.01% by mass to about 5% by mass, and is more preferably in the range of about 0.1% by mass to about 5% by mass, with respect to the total amount of the toner. When the amount of the infrared absorbing agent added is lower than about 0.01% by mass, the toner may not be fixed in the case of being applied to flash fixing. When the amount is higher than about 5% by mass, the toner color may become cloudy.

The method for manufacturing the electrophotographic toner of the invention is described in more detail.

The toner of the exemplary embodiment can be prepared by methods similar to known methods for manufacturing a toner, such as a pulverization method or a polymerization method.

When the pulverization method is used, the alkali metal salt of polyethylene oxide and the binder resin are mixed with components such as a coloring agent, a wax composition or a charging regulator as necessary, and these materials are melt-kneaded by means of a kneader, an extruder or the like. Thereafter, the melt-kneaded material thus obtained is coarsely pulverized with, then finely pulverized with a jet mill, and classified with an air classifier to give toner particles having the objective particle diameter. Further, in a post-treatment, the shape of the pulverized toner can be changed by applying mechanical external force by means of a HYBRIDIZATION SYSTEM (manufactured by Nara Machinery Co., Ltd.), a MECHANO-FUSION SYSTEM (manufactured by Hosokawa Micron Co., Ltd.), a KRIPTRON system (manufactured by Kawasaki Heavy Industries, Ltd.) or the like. Spheronization by hot air may also be performed. Further, the toner particle diameter distribution may be regulated by classification with an air classifier.

Thereafter, an external additive is added to the toner particles if necessary, whereby the toner of the exemplary embodiment can be obtained.

When the polymerization method is used, a suspension polymerization method or an emulsion polymerization method may be mainly used.

When the toner of the exemplary embodiment is prepared by using the suspension polymerization method, a monomer such as styrene, butyl acrylate or 2-ethylhexyl acrylate, a crosslinking agent such as divinyl benzene, a chain transfer agent such as dodecyl mercaptan, and a polymerization initiator are first added to the alkali metal salt of polyethylene oxide are mixed, and a coloring agent, a charging regulator, a wax composition and the like may be further added thereto if necessary, and these materials are mixed to prepare a monomer composition.

Thereafter, the monomer composition is introduced into an aqueous phase containing a suspension stabilizer and a surfactant such as tricalcium phosphate or polyvinyl alcohol, and then emulsified by means of a rotor stator emulsifier, a high-pressure emulsifier or an ultrasonic emulsifier to give an emulsion, followed by heating to polymerize the monomer, to give particles. After the polymerization is finished, the resulting particles are washed and dried, if necessary followed by adding an external additive, whereby the toner of the exemplary embodiment can be obtained.

When the toner is prepared by the emulsion polymerization method, a monomer such as styrene, butyl acrylate or 2-ethylhexyl acrylate is added to an aqueous solution of a water-soluble polymerization initiator such as potassium persulfate, if necessary followed by adding a surfactant such as sodium dodecyl sulfate, and the mixture is heated under stirring for polymerization to give resin particles.

Thereafter, the alkali metal salt of polyethylene oxide and if necessary powders of a coloring agent, a charging regulator, a wax composition and the like are added to the suspension having the resin particles dispersed therein, and then the pH, stirring rate, temperature etc. of the suspension are regulated to cause heteroaggregation of powders of the alkali metal salt of polyethylene oxide and the like to obtain hetero-aggregates. Thereafter, the reaction system is heated to a temperature higher than the glass transition temperature of the resin particles so that the hetero-aggregates fuse to give toner particles. Thereafter, the toner particles are washed and dried, if necessary followed by adding an external additive, whereby the toner of the exemplary embodiment can be obtained.

A volume average particle diameter (D50*v*) of the toner particles obtained by the manufacturing method is preferably in the range of about 3 μm to about 10 μm, and is more preferably in the range of about 4 μm to about 8 μm. The ratio of the volume average particle diameter D50*v* to the number average particle diameter D50*p* (D50*v*/D50*p*) of the loner particles may be in the range of about 1.0 to about 1.25. By using such toner having a small and uniform particle diameter, fluctuation in the charging performance of the toner may be prevented, thus reducing fog in an image formed by the toner and simultaneously improving the fusing property of the toner. Thin-line reproducibility and dot reproducibility in an image formed by the toner may also be improved.

The average circularity of the toner particle is preferably about 0.9 or more, and is more preferably about 0.960 or more. The standard deviation of the circularity is preferably about 0.040 or less, and is more preferably about 0.038 or less. When the toner has a shape satisfying these conditions, the toner particles may be superimposed in a condensed state on a recording medium so as to make the thickness of the toner layer on the recording medium thinner and increase the fusing property thereof. In addition, uniformization of the shape of the toner particles contributes to reduction of fogging and improvement in the thin line reproducibility and dot reproducibility of the image formed of the toner.

The average circularity (circular perimeter/actual perimeter) of the toner particle can be calculated by determining the perimeter of the projected image of a particle in an aqueous dispersion system and the circumferential length (circular perimeter) of a circle having an identical area to the projected area of the toner particle by using a flow-type particle image analyzer (trade name: FPIA2000, manufactured by Sysmex Corp.).

On the other hand, if the toner particles are prepared in a wet granulation method, the shape factor SF1 of the toner particle may be in the range of about 110 to about 135.

The toner shape factor SF1 is determined by sending the shape image or optical microscopic image of toner particles spread on a slide glass via a video camcorder into a LUZEX image-analyzing instrument; measuring the maximum lengths and the projected areas of 50 or more toner particles; and calculating according to the following Equation (1).

$$SF1=(ML^2/A)\times(\pi/4)\times 100 \qquad \text{Equation (1)}$$

In Equation (1), ML represents the absolute maximum length of a toner particle, and A represents the projected area of the toner particle.

In addition, the volume particle diameter distribution index GSDv of the toner particle may be about 1.25 or less.

The volume-average particle diameter, the particle diameter distribution indicator, and the like of the toner according to the invention are determined by using COULTER COUNTER TAII (trade name, manufactured by Beckmann-Coulter Inc.), and ISOTON-II (trade name, manufactured by Beckmann-Coulter) as the electrolyte.

Based on the particle diameter distribution thus determined, the volume and the number of toner particles in each of the particle diameter range (channel) previously partitioned are obtained and plotted from the smallest side, to give a cumulative distribution curve; and the particle diameters at a cumulative point of 16% are designated respectively as volume-average particle diameter D16*v* and number-average particle diameter D16*p*; and those at a cumulative point of 50%, as volume-average particle diameter D50*v* (representing the volume-average particle diameter of the toner described above) and the number-average particle diameter D50*p*. In the similar manner, the particle diameters at a cumulative point of 84% were designated respectively as volume-average particle diameter D84*v* and the number-average particle diameter D84*p*. The volume-average particle distribution index (GSDv) is calculated as a square root of 84v/D16*v* by using the values above.

Inorganic particles and/or resin particles may be added to the toner of the exemplary embodiment for improvement in fluidity of the toner. The amount thereof blended to the toner particle may be in the range of about 0.01 to about 5 parts by mass, and preferably in the range of about 0.01 to about 2.0 parts by mass with respect to 100 parts by mass of the toner particle.

Examples of the inorganic particles include silica fine powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, bengala, antimony trioxide, magnesium oxide, zirconium oxide, barium sulfate, barium carbonate, calcium carbonate, silicon carbide, silicon nitride, and the like, and silica fine powder.

Examples of the resin particles include those formed of polystyrene, polymethyl methacrylate, melamine resins or the like. In addition, metal salts of higher fatty acids, which are typically zinc stearate, or fine particle powders of a fluorochemical polymer may be added to the toner as a cleaning activator.

The toner of the exemplary embodiment can be prepared by sufficiently blending the inorganic fine particles and desired additives as needed in a mixer such as a HENSCHEL mixer or the like.

Electrophotographic Image Developer

The electrophotographic image developer of one exemplary embodiment of one aspect of the invention (hereinafter sometimes abbreviated as a "developer") may be either a single-component developer containing the toner or a two-component developer containing a carrier and the toner.

Details of the electrophotographic image developer of one exemplary embodiment of one aspect of the invention is hereinafter described in consideration of the case that the developer is a two-component developer.

There is no particular restriction to the carrier for use in the two-component developer, and examples thereof include a resin-coated carrier having a resin coating layer on a surface of a core material thereof. Examples thereof further include a resin dispersion carrier in which an electrically conductive material is dispersed in a matrix resin.

Examples of a resin for the resin coating layer or the matrix resin used in the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin comprising organosiloxane bonds or a modified product thereof a fluororesin, a polyester, a polycarbonate, a phenolic resin, and an epoxy resin, while the scope of the carrier is not limited to these.

Examples of the electrically conductive material used as the coating on the carrier include a metal such as gold, silver or copper, carbon black, titanium oxide, zinc oxide, barium sulfate, aluminum borate, potassium titanate, tin oxide, and carbon black, while the scope of the electrically conductive material is not limited to these.

Examples of the core material of the carrier include a magnetic metal such as iron, nickel or cobalt, a magnetic oxide such as ferrite or magnetite, and a glass bead. The core material may be a magnetic substance when the carrier is used in a magnetic brush method. The volume-average particle diameter of the core material of the carrier is generally in the range of about 10 μm to about 500 μm, and is preferably in the range of about 20 μm to about 60 μm.

Examples of methods for coating the surface of the core material of the carrier with a resin include a method including applying, to the surface of the core material, a coating liquid for forming the resin layer in which the resin and arbitrary additives if necessary are dissolved in an appropriate solvent. The solvent is not particularly limited and may be selected as appropriate in consideration of the coating resin to be used, suitability for coating, and the like.

Specific examples of the resin coating method include: an immersion method in which the core material of the carrier is immersed in the coating liquid; a spray method in which the coating liquid is sprayed onto the surface of the core material of the carrier; a fluidized bed method in which the coating liquid is sprayed onto the core material of the carrier that is floated by fluidizing air; and a kneader coater method in which the core material of the carrier is mixed with the coating liquid in the kneader coater and the solvent is removed.

The mixing ratio (ratio in terms of mass) of the toner of the invention to the carrier in the two-component developer (toner: carrier) is preferably in the range of about 1:100 to about 30:100, and is more preferably in the range of about 3:100 to about 20:100.

Process Cartridge and Image Forming Apparatus

The image forming apparatus in the exemplary embodiment is not particularly limited as long as it can form a fixed image of a toner image on a recording medium by using the developer containing the electrophotographic toner. Specific examples thereof include an image forming apparatus having at least a toner image forming unit (a toner image forming member) that forms a toner image on a recording medium and a fixing unit (a fixing member) that fixes the toner image on the recording medium.

When a photoreceptor for electrophotography is used as the electrostatic image-holding member, the image formation may be performed, for example, as follows. First, the surface of the photoreceptor for electrophotography is charged uniformly in a Corotron electrostatic charging device, a contact electrostatic charging device, or the like, and exposed to light to form an electrostatic image. Then, a toner image is formed on the photoreceptor for electrophotography by bringing the photoreceptor into contact with or closer to a developing roll carrying a surface developer layer and thus adhering toner particles onto the electrostatic image. The toner image formed is then transferred onto the surface of an image-receiving medium such as paper by using a Corotron electrostatic charging device or the like. Further, the toner image transferred onto the recording medium surface is then fixed by using a fixing device to form an image on the recording medium.

Typical examples of the photoreceptors for electrophotography include inorganic photoreceptors such as amorphous silicon or selenium; and organic photoreceptors using polysilane, phthalocyanine or the like as a charge-generating material or an electric charge-transferring material, and an amorphous silicon photoreceptor is particularly preferable as it has a longer lifetime.

The fixing device may be any device as long as it is capable of fixing by heating-and-pressurizing or photoirradiation. A flash fixing device can be used when the electrophotographic toner of the exemplary embodiment of one aspect of the invention is utilized as a toner for flash fixing. When the electrophotographic toner is used in applications other than the flash fixing, a heat roll fixing device, an oven fixing device and the like may be used.

As the heat roll fixing device, a heat roll fixing device having a pair of fixing rolls arranged to be opposite to each other in a press-contacted state is generally used. As the pair of fixing rolls, a heat roll and a pressure roll are arranged to be opposite to each other in a press-contacted state to form a nip. The heat roll has an oil-resistant and heat-resistant elastic layer and a surface layer made of a fluorine resin or the like which are provided in this order on a hollow metal core having a heater lamp therein, and the pressure roll includes an oil-resistant and heat-resistant elastic layer (elastic layer) and a surface layer formed in this order on a hollow metal core having a heater lamp therein if necessary. The recording medium having an unfixed toner image formed thereon is passed through the nip area formed between the heat roll and the pressure roll, thereby fixing the unfixed toner image.

Examples of the light source for use in the flash fixing device include common halogen lamps, mercury lamps, flash lamps, infrared lasers, and the like, and among them, instantaneous fixing by a flash lamp may be most effective for energy saving. The emission energy of the flash lamp is preferably in the range of about 1.0 $J/cm^{-1}$ to about 7.0 $J/cm^2$ and is more preferably in the range of about 2 $J/cm^2$ to about 5 $J/cm^2$.

The emission energy of a flash light per unit area, an indicator of the intensity of a xenon lamp strength, is represented by the following Equation (2).

$$S=((1/2)\times C\times V^2)/(u\times L)\times(n\times f) \quad \text{Equation (2)}$$

In Equation (2), n represents the number of the lamps lighted at the same time; f represents a lighting frequency (Hz); V represents an input voltage (V); C represents a condenser capacity (F); u represents a process traveling speed (cm/s); L represents the effective lighting width of the flash lamps (usually, the maximum paper width (cm)); and S represents an energy density ($J/cm^2$).

The flash fixing process can be a delayed process in which multiple flash lamps are lightened at a time interval. The delayed process is a process of placing multiple flash lamps in a row, lighting the respective lamps at an interval of about 0.01 ms to about 100 ms, and irradiating the same area of an toner image multiple times. In this manner, the process, which applies fractioned light energies, not all at once, but several times onto a toner image, makes the fixing condition milder and provides both superior void resistance and fixing efficiency.

When a toner image is irradiated with flash lights multiple times, the emission energy of the flash lamps herein means the total amount of the emission energies per unit area of respective flash lights.

In the invention, the number of the flash lamps is preferably in the range of about 1 to about 20, and is more preferably in the range of about 2 to about 10. Additionally the time interval between the multiple flash lamp lighting is preferably in the range of about 0.1 msec to about 20 msec, and is more preferably in the range of about 1 msec to about 3 msec.

Yet additionally, the emission energy of single flash lamp lighting is preferably in the range of about 0.1 to about 1 $J/cm^2$, and is more preferably in the range of about 0.4 to about 0.8 $J/cm^2$.

As one example of the image forming apparatus in the exemplary embodiment, an image forming apparatus provided with a heat roll fixing device and a flash fixing apparatus (flash fixing device) is described with reference to the drawings.

FIG. 1 is a schematic diagram showing one example of the image forming apparatus provided with a heat roll fixing device. The image forming apparatus 100 is a high-speed machine having a processing speed (paper delivery speed) of not lower than 1,000 mm/sec., wherein a roll paper (continuous form paper) is used as the recording medium. As shown in FIG. 1, a roll paper feeding part 12 is arranged in the image forming apparatus 100. A roll paper (continuous form paper) 16 set in the roll paper feeding part 12 is delivered via feed roll 21 and pinch roll 22 to an image forming part (toner image forming member) 37.

A developing device 38 in the image forming part 37 is charged with the developer in the exemplary embodiment, and a toner image formed on photoreceptor 40 with the developing device 38 in the image forming part 37 is transferred in a transfer part 42 to the delivered roll paper 16. Then, the toner image transferred to the roll paper 16 is fixed with a fixing device (fixing member) 44 composed of a fixing roll and a pressure roll, and then delivered to a transfer part 39.

The transfer part 39 is provided with a cutter (post-treatment member) 33 and a paper sensor 46 for detecting passage of the top of the roll paper 16 provided at a region downstream of the cutter. An encoder 48 is arranged downstream from the paper sensor 46 and rotated with a roll 47 for delivering the roll paper, to output a pulse signal at predetermined intervals during rotation.

When the paper sensor 46 detects the top of the roll paper 16, it outputs a detection signal to a regulating device not shown in the figure. Then, the regulating device receives the pulse signal outputted from the encoder 48, determines the driving timing of cutter 33, and allows the cutter to cut the roll paper 16 into an output paper P of specified size. The output paper P thus cut is discharged onto a discharge tray 60.

In the configuration described above, the cutter 33 is contacted with the roll paper 16 having a fixed image formed thereon and running continuously at high speed, and thus the fixed image is frequently rubbed against the cutter 33, while the cutter 33 is hardly stained owing to use of a developer containing the toner of the exemplary embodiment. The processing speed of the image forming apparatus may be about 1,000 mm/sec or higher.

Another example of the image-forming apparatus of the exemplary embodiment of one aspect of the invention will be described below.

Figure 2:
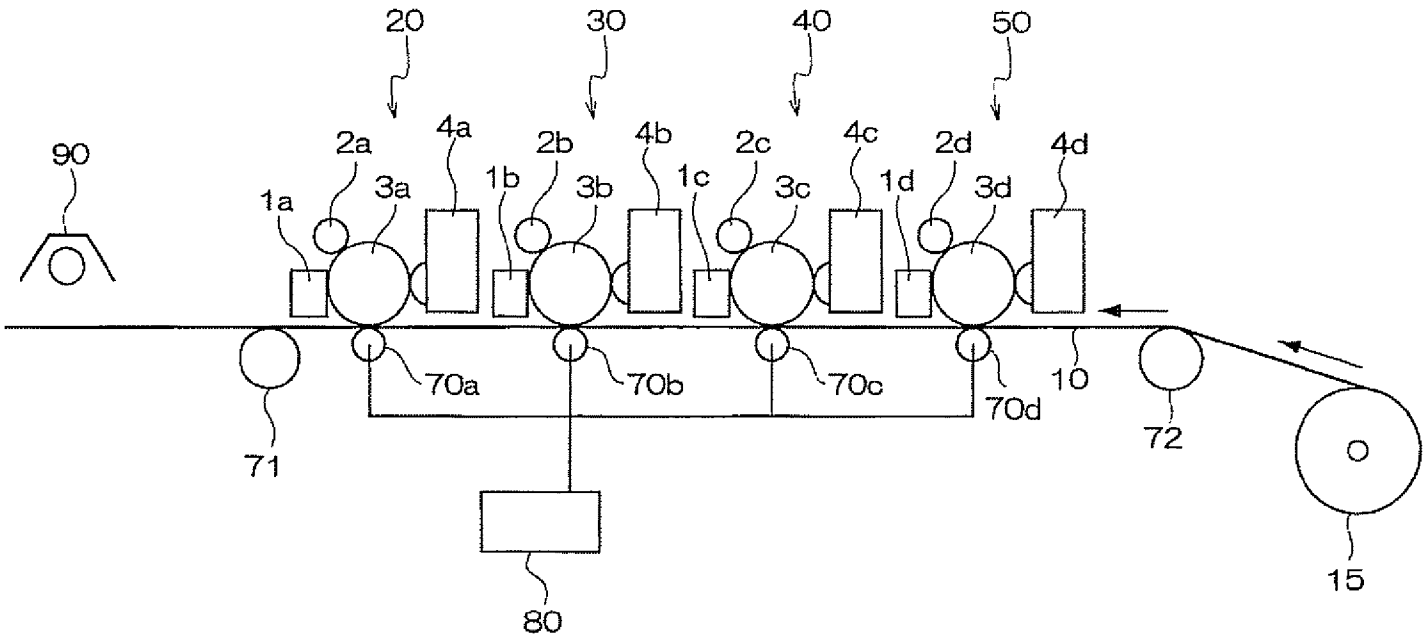
FIG. 2 is a schematic diagram illustrating another example of the image-forming apparatus according to one exemplary embodiment of the invention.

FIG. 2 is a schematic view illustrating an example of the image-forming apparatus having the flash fixing device. The apparatus shown in FIG. 2 forms a toner image by using a black toner in addition to three color toners in cyan, magenta, and yellow. The processing speed of the image forming apparatus is also set about 1,000 mm/sec or higher.

In FIG. 2, 1*a* to 1*d* each represent a charging device; 2*a* to 2*d* each represent an exposure device; 3*a* to 3*d* each represent a photoreceptor (electrostatic image-holding member); 4*a* to 4*d* each represent a developing device; 10 represents a recording paper (recording medium) fed from a roll medium 15 in the arrow direction; 20 represents a cyan developing unit; 30 represents a magenta developing unit; 40 represents a yellow developing unit; 50 represents a black developing unit; 70*a* to 70*d* each represent a transfer device (transfer roller); 71 and 72 each represent a roller; 80 represents a transfer voltage-supplying device; and 90 represents a flash fixing device.

The image-forming apparatus shown in FIG. 2 has developing units for toners different in color represented by 20, 30, 40 and 50, each having a charging device, an exposure device, a photoreceptor, and a developing device; rolls 71 and 72 for conveying a recording paper 10 placed in contact with the recording paper 10; transfer rolls 70*a*, 70*b*, 70*c* and 70*d* for pressing the recording paper 10 onto the photoreceptors of respective developing units that are placed on the other side of the recording paper with respect to the photoreceptor; a transfer voltage-supplying device 80 for supplying a voltage to the three transfer rolls; and a flash fixing device 90 for irradiating a light onto the photoreceptor side of the recording paper 10 that is traveling through the nip areas between the photoreceptors and the transfer rolls in the direction indicated by the arrows in FIG. 2.

In the cyan developing unit 20 an electrostatic charging device 1*a*, an exposure apparatus 2*a*, and a developing device 4*a* are placed clockwise around a photoreceptor 3*a*. In addition, the transfer roll 70*a* is placed on the other side of the recording paper 10 so that transfer roll 70*a* comes into contact with the surface of the photoreceptor 3*a* via the recording paper 10 in the area between the position of the developing device 4*a* and the electrostatic charging device. Other developing units for toners different in color also have the same structure. In the image-forming apparatus according to the exemplary embodiment, the developing device 4*a* in the developing unit 20 is loaded with a developer containing the above-described cyan toner and the developing devices of the other developing units are respectively loaded with the toners for flash fixing corresponding to the respective other colors.

Image formation using the image-forming apparatus can be as follows. First, the surface of the photoreceptor 3*d* is charged by the charging device 1*d* while the photoreceptor 3*d* is rotated in the clockwise direction in the black developing unit 50. A latent image corresponding to the black component image of an original image to be copied is then formed on the surface of the photoreceptor 3*d*, by photoirradiation of the surface of the charged photoreceptor 3*d* by the exposure device 2*d*. Then, the latent image is further developed into a black toner image by application of the black toner loaded in the developing device 4*d*. The same process also proceeds in the yellow developing unit 40, the magenta developing unit 30 and the cyan developing unit 20, forming toner images in respective colors on the photoreceptor surfaces of respective developing units.

The respective toner images formed on the photoreceptor surface are transferred one by one onto the recording paper 10 conveyed in the arrowed direction by the transfer voltage applied through the transfer rolls 70*a* to 70*d*, forming a full-color layered toner image corresponding to the original image information in cyan, magenta, yellow and black in that order from the top on the surface of the recording paper 10.

Subsequently, the layered toner image formed on the recording paper 10 is conveyed to the flash fixing device 90, where the layered toner image is fixed by photoirradiation by the flash fixing device to form a flash fixed full-color image on the recording paper 10.

The thus formed toner image is further subjected to processing using post-processing apparatus (post-processing devices) such as a cutter or a packing-sealing machine (not shown in FIG. 2) or the like to be appropriately used as an image accords to various intended purposes.

When the electrophotographic toner of the exemplary embodiment is used, for example, as a color toner for flash fixing, the toner may be used in various applications such as newspaper, service bureau, bar code printing, label printing, tag printing, printers in a Carlson system or an ion-flow system or copies. The electrophotographic toner of the exemplary embodiment may provide inexpensive products exhibiting excellent flash fixability, and may thus easily cope with demand for colorization of images in these applications.

EXAMPLES

Hereinafter, the present invention will be described more specifically with reference to Examples, while the invention is not limited thereby.

Preparation of Electrophotographic Toner

Figure 3:
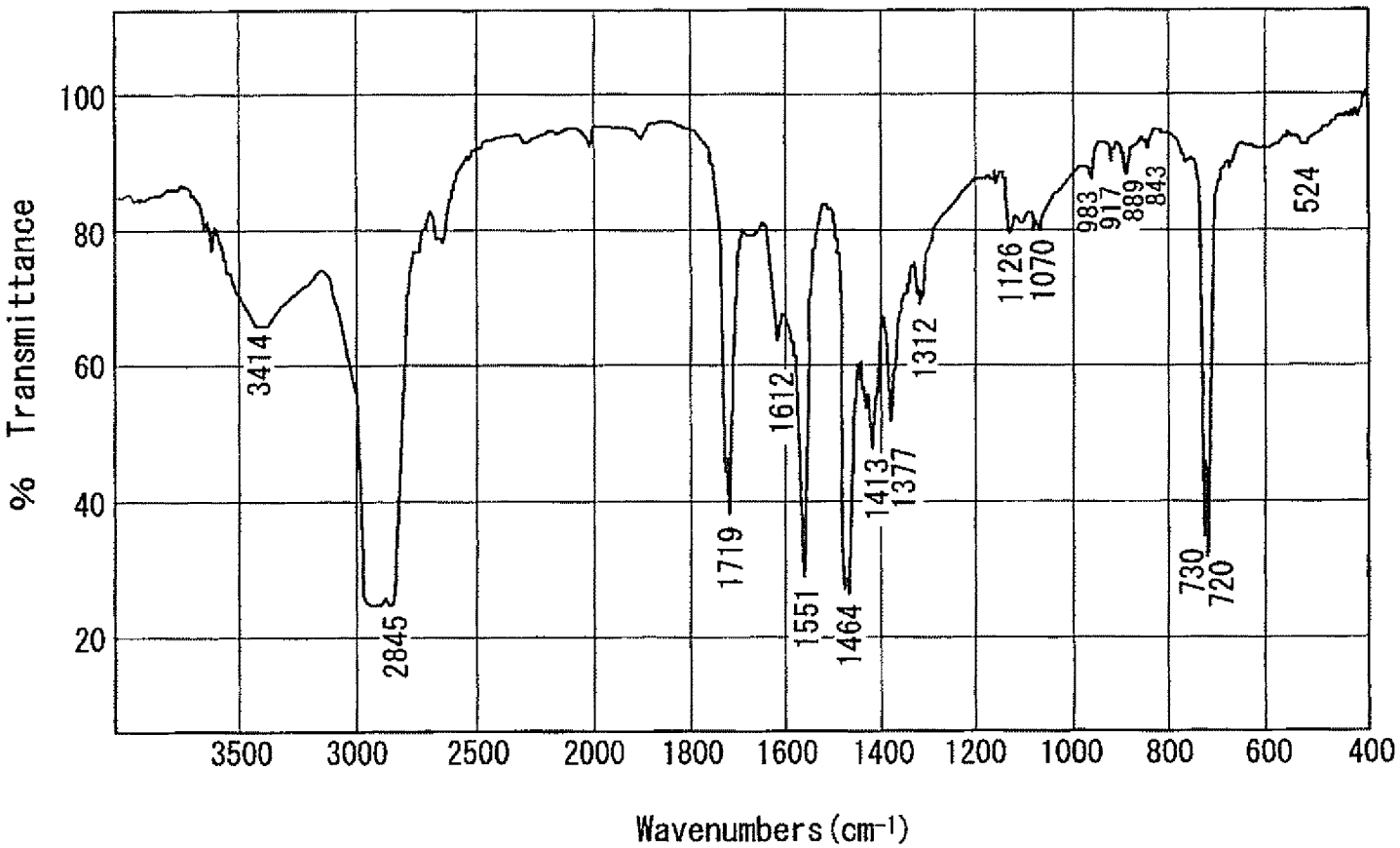
FIG. 3 is a diagram showing an infrared absorption spectrum of alkali metal salt of polyethylene oxide.

A potassium salt (trade name: POLYMECON, manufactured by Toyo Petrolite kabusiki Kaisha, a weight average molecular weight: 720) is used as an alkali metal salt of polyethylene oxide in the Examples. An infrared absorption spectrum (FT-IR) of the alkali metal salt of polyethylene oxide is shown in FIG. 3. This measurement is conducted under the following conditions.

FT-IR Measurement Conditions

A pressed film is prepared from a granular sample by the KBr method and measured for its IR spectrum under the following conditions.

Measuring instrument: Infrared spectrophotometer (FT-IR, FTS-600, manufactured by Bio-Rad)

Measurement Method:

Measurement method: film-transmission method

Measurement range: 4,000 $cm^{-1}$ to 400 $cm^{-1}$

Resolution: 4 $cm^{-1}$

Accumulation times: 128 times

In the infrared absorption spectrum shown in FIG. 3, absorptions of crystalline linear methylene are observed strongly at 720 $cm^{-1}$ and 730 $cm^{-1}$. Accordingly, the base polymer can be confirmed to be polyethylene. It can be seen that at 1719 $cm^{-1}$, there is an absorption peak Ph attributable to a carboxylic acid-derived carbonyl group, and at 1561 $cm^{-1}$, there is an absorption peak Pm attributable to a carboxylic acid metal salt. The metal contained in the metal salt is confirmed to be potassium by fluorescent X-ray analysis.

According to each of the formulations shown in Table 1, the toner materials are introduced into a Henschel mixer, then premixed and kneaded at 250 rpm by an extruder (trade name: PCM-30, manufactured by Ikegai Corporation) at 190° C. Then, the kneaded mixture is coarsely pulverized with a hammer mill, finely milled with a jet mill, and classified with an air classifier to give toner particles having a volume average particle diameter of 6.0 μm to 6.5 μm.

Then, 98.5 parts of the toner particles are treated with 1.5 parts of hydrophobic silica particles (trade name: TG820, manufactured by Cabot Japan) as an external additive with a Henschel mixer (trade name: FM-74, manufactured by Mitsui Miike Machinery Co., Ltd.) to give each of optically fixing toners CT-1 to CT-18. MT-1, YT-1 and BT-1.

TABLE 1

| | Wax (parts) | | | | | | | | |
|---|---|---|---|---|---|---|---|---|---|
| | Alkali metal salt of oxidized polyethylene | Polyethylene | | | | Other wax | | | |
| Toner | WAX-1 | WAX-2 | WAX-3 | WAX-4 | WAX-5 | WAX-6 | WAX-7 | WAX-8 | WAX-9 |
| CT-1 | — | — | — | — | — | 3.0 | 2.0 | — | — |
| CT-2 | — | 1.0 | — | — | — | 3.0 | 2.0 | — | — |
| CT-3 | — | — | 1.0 | — | — | 3.0 | 2.0 | — | — |
| CT-4 | — | — | — | 1.0 | — | 3.0 | 2.0 | — | — |
| CT-5 | — | — | — | — | 1.0 | 3.0 | 2.0 | — | — |
| CT-6 | 0.5 | — | — | — | — | 3.0 | 2.0 | — | — |
| CT-7 | 1.0 | — | — | — | — | 3.0 | 2.0 | — | — |
| CT-8 | 3.0 | — | — | — | — | 3.0 | 2.0 | — | — |
| CT-9 | 10 | — | — | — | — | 3.0 | 2.0 | — | — |
| CT-10 | 1.0 | 1.0 | — | — | — | 3.0 | 2.0 | — | — |
| CT-11 | 1.0 | — | 1.0 | — | — | 3.0 | 2.0 | — | — |

TABLE 1-continued

| | | | | | | | | | |
|---|---|---|---|---|---|---|---|---|---|
| CT-12 | 1.0 | — | — | 1.0 | — | 3.0 | 2.0 | — | — |
| CT-13 | 1.0 | — | — | — | 1.0 | 3.0 | 2.0 | — | — |
| CT-14 | 3.0 | — | — | — | 1.0 | 3.0 | 2.0 | — | — |
| CT-15 | 1.0 | — | — | — | 3.5 | 3.0 | 2.0 | — | — |
| CT-16 | 0.5 | — | — | — | 7.0 | 3.0 | 2.0 | — | — |
| CT-17 | 1.0 | — | — | — | — | 3.0 | 2.0 | 1.0 | — |
| CT-18 | 1.0 | — | — | — | — | 3.0 | 2.0 | — | 1.0 |
| MT-1 | 1.0 | — | — | — | 1.0 | 3.0 | 2.0 | | |
| YT-1 | 1.0 | — | — | — | 1.0 | 3.0 | 2.0 | | |
| BT-1 | 1.0 | — | — | — | 1.0 | 3.0 | 2.0 | | |

| | Other components (parts) | | | | | | | | External additive (parts) |
|---|---|---|---|---|---|---|---|---|---|
| | Binder resin | Charging regulator | | | | | | | |
| Toner | Polyester | TP415 | P51 | IAA | C | M | Y | B | Silica |
| CT-1 | 85.5 | 0.5 | 0.5 | 2 | 5.0 | — | — | — | 1.5 |
| CT-2 | 84.5 | 0.5 | 0.5 | 2 | 5.0 | — | — | — | 1.5 |
| CT-3 | 84.5 | 0.5 | 0.5 | 2 | 5.0 | — | — | — | 1.5 |
| CT-4 | 84.5 | 0.5 | 0.5 | 2 | 5.0 | — | — | — | 1.5 |
| CT-5 | 84.5 | 0.5 | 0.5 | 2 | 5.0 | — | — | — | 1.5 |
| CT-6 | 85.0 | 0.5 | 0.5 | 2 | 5.0 | — | — | — | 1.5 |
| CT-7 | 84.5 | 0.5 | 0.5 | 2 | 5.0 | — | — | — | 1.5 |
| CT-8 | 82.5 | 0.5 | 0.5 | 2 | 5.0 | — | — | — | 1.5 |
| CT-9 | 75.5 | 0.5 | 0.5 | 2 | 5.0 | — | — | — | 1.5 |
| CT-10 | 83.5 | 0.5 | 0.5 | 2 | 5.0 | — | — | — | 1.5 |
| CT-11 | 83.5 | 0.5 | 0.5 | 2 | 5.0 | — | — | — | 1.5 |
| CT-12 | 83.5 | 0.5 | 0.5 | 2 | 5.0 | — | — | — | 1.5 |
| CT-13 | 81.5 | 0.5 | 0.5 | 2 | 5.0 | — | — | — | 1.5 |
| CT-14 | 81.5 | 0.5 | 0.5 | 2 | 5.0 | — | — | — | 1.5 |
| CT-15 | 81.0 | 0.5 | 0.5 | 2 | 5.0 | — | — | — | 1.5 |
| CT-16 | 77.0 | 0.5 | 0.5 | 2 | 5.0 | — | — | — | 1.5 |
| CT-17 | 83.5 | 0.5 | 0.5 | 2 | 5.0 | — | — | — | 1.5 |
| CT-18 | 83.5 | 0.5 | 0.5 | 2 | 5.0 | — | — | — | 1.5 |
| MT-1 | 83.5 | 0.5 | 0.5 | 2 | — | 5.0 | — | — | 1.5 |
| YT-1 | 83.5 | 0.5 | 0.5 | 2 | — | — | 5.0 | — | 1.5 |
| BT-1 | 83.5 | 0.5 | 0.5 | 2 | — | — | — | 5.0 | 1.5 |

Abbreviations and names shown in Table 1 are explained below:

IAA: Infrared absorbing agent

C: Cyan pigment (Pigment Blue 15 (trade name: BLPO, manufactured by Ciba Specialty Chemicals))

M: Magenta pigment (C. I. Pigment Red 57:1 (trade name: IRGALITE Magenta SMB, manufactured by Ciba Specialty Chemicals))

Y; Yellow pigment (C. I. Pigment Yellow 74 (trade name: IRGALITE Yellow GO, manufactured by Ciba Specialty Chemicals))

B: Black pigment (carbon black (trade name: BLP, manufactured by Cabot Japan))

Charging regulator: quaternary ammonium salt (trade name: TP415, manufactured by Hodogaya Chemical Co., Ltd.)

quaternary ammonium salt (trade name: P-51, manufactured by Orient Chemical Industries, Ltd.)

Binder resin, polyester resin (trade name: FP131, manufactured by Kao Corporation)

Infrared absorbing agent: aluminum salt compound (trade name. IRG-002, manufactured by Nippon Kayaku Co., Ltd.)

External additive: silica (trade name: TG820, manufactured by Cabot Japan)

WAX-1: Alkali metal salt of polyethylene (trade name: POLYMECON, manufactured by manufactured by Toyo Petrolite kabusiki Kaisha)

WAX-2: Polyethylene (trade name: PE130, with a weight average molecular weight of 4073, manufactured by Clariant Japan)

WAX-3: Polyethylene (trade name: 400P, with a weight average molecular weight of 6060, manufactured by Mitsui Chemicals, Inc.)

WAX-4: Polyethylene (trade name: 800P, with a weight average molecular weight of 12300, manufactured by Mitsui Chemicals, Inc.)

WAX-5: Polyethylene (trade name: PE190, with a weight average molecular weight of 23300, manufactured by Clariant Japan)

WAX-6: Polyester wax (trade name: WEP-5F, manufactured by NOF Corporation)

WAX-7: Polypropylene (trade name: NP500, manufactured by Mitsui Chemicals, Inc.)

WAX-8. Polypropylene (trade name: C-10, with a weight average molecular weight of 35000, manufactured by Eastman Kodak Co.)

WAX-9: Polypropylene (trade name: C-17, with a weight average molecular weight of 100000, manufactured by Eastman Kodak Co.)

Preparation of Developer

The resulting toner is used to prepare a two-component developer. A general-purpose carrier having a volume-average particle diameter of 60 μm coated with a silicone resin (trade name. SR2411, manufactured by Toray-Dow Corning Silicone Corp.) is used as a carrier to be mixed with the toner. 95.5 parts of the carrier are mixed with 4.5 parts of the toner and then mixed for 2 hours in a 10-L ball mill to prepare 3.5 kg developer. The developer thus obtained is used to evaluate fixing property and color reproducibility by the following methods.

Examples 1 to 16, Comparative Examples 1 to 5

Evaluation of Blocking Resistance

About 10 g of each toner is placed in a 50 ml plastic cup and then left at 55° C. for 24 hours, and the blocking of the toner is evaluated by visual observation under the following criteria.

A: Very good (no change).

B: Good (aggregates are observed while it is easily loosened).

C. Ordinary (there is an aggregate which is hardly loosened).

X: Unfavorable (there is an aggregate which is not loosened (caking)).

Evaluation of Smear Resistance

Image evaluation including fixing property is carried out using each of the developers. The apparatus used in this evaluation is a rebuilt version of CF1100 printer (trade name, manufactured by Fuji Xerox Co., Ltd, processing speed of 1430 mm/sec., corresponding to 500 sheets of A4 paper per minute) loaded with a xenon flash lamp having high emission intensity in the wavelength range of 700 nm to 1500 nm. The emission energy of the flash lamp is set at 3.0 J/cm$^2$, and the display time is set at 0.5 msec.

Plain paper (trade name: NIP-1500LT, manufactured by Kobayashi Create Co., Ltd.) is used as a recording medium to form an image having a size of 1 inch×1 inch (2.54 cm×2.54 cm) by the image forming apparatus. Specifically, each color toner for flash fixing shown in Table 1 is used to form an image in which the amount of the adhering toner (the amount of the toner on the recording medium) is regulated to be 0.5 mg/cm$^2$ at single color.

Smear resistance is evaluated by rubbing the fixed image 10 times against a soft thin paper charged with a loading of 50 g/cm$^2$ and then measuring a degree (%) of reduction in image density before and after rubbing, to determine smear resistance under the following criteria. X-RITE 938 (trade name, manufactured by X-Rite) is used in the measurement of optical density.

A: Very good (decree of reduction: less than about 5%).

B: Good (degree of reduction: 5% or more to less than about 10%).

C: Ordinary (degree of reduction: 10% or more to less than about 20%).

X: Unfavorable (degree of reduction: about 20% or more).

The evaluation results are collectively shown in Table 2.

TABLE 2

| | Toner No. | Smear Resistance | Blocking Resistance |
|---|---|---|---|
| Example 1 | CT-6 | C | B |
| Example 2 | CT-7 | B | B |
| Example 3 | CT-8 | B | B |
| Example 4 | CT-9 | B | C |
| Example 5 | CT-10 | B | C |
| Example 6 | CT-11 | B | C |
| Example 7 | CT-12 | A | B |
| Example 8 | CT-13 | A | A |
| Example 9 | CT-14 | A | B |
| Example 10 | CT-15 | A | B |
| Example 11 | CT-16 | B | C |
| Example 12 | CT-17 | A | A |
| Example 13 | CT-18 | C | B |
| Example 14 | MT-1 | A | B |
| Example 15 | YT-1 | A | B |
| Example 16 | BT-1 | B | B |
| Comparative example 1 | CT-1 | X | B |
| Comparative example 2 | CT-2 | X | X |
| Comparative example 3 | CT-3 | X | X |
| Comparative example 4 | CT-4 | X | C |
| Comparative example 5 | CT-5 | X | C |

As shown in Table 2, the toners containing the potassium metal salt of polyethylene oxide in the Examples are excellent in both smear resistance and blocking resistance. On the other hand, the toners which do not contain the potassium metal salt of polyethylene oxide in the Comparative examples are problematic in smear resistance and/or blocking resistance.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by references

What is claimed is:

1. An electrophotographic toner comprising: a binder resin, a coloring agent, an alkali metal salt of oxidized polyethylene, and a polyethylene having a weight-average molecular weight in a range of about 12,000 to about 100,000, wherein the alkali metal salt of oxidized polyethylene includes a carboxyl group that forms a salt with an alkali metal ion.

2. The electrophotographic toner according to claim 1, wherein the alkali metal ion is a potassium ion.

3. The electrophotographic toner according to claim 1, wherein the weight average molecular weight of the oxidized polyethylene is in a range of about 600 to about 900.

4. The electrophotographic toner according to claim 1, wherein the acid value of the oxidized polyethylene is in a range of about 6 mg KOH/g to about 30 mg KOH/g.

5. The electrophotographic toner according to claim 1, wherein the amount of the alkali metal salt of oxidized polyethylene contained in the toner is in the range of about 0.5% by mass to about 10% by mass with respect to the total amount of the toner.

6. The electrophotographic toner according to claim 1, further comprising an infrared absorber.

7. The electrophotographic toner according to claim 1, wherein the binder resin is a polyester resin.

8. The electrophotographic toner according to claim 7, wherein about 80 mol % or more of an alcohol component in the polyester resin is an alkylene oxide adduct of bisphenol A.

9. The electrophotographic toner according to claim 6, wherein the infrared absorber has at least one light absorption peak at a wavelength in the near-infrared region of about 800 nm to about 2,000 nm.

10. The electrophotographic toner according to claim 6, wherein the amount of the infrared absorber contained in the toner is in the range of about 0.01% by mass to about 5% by mass with respect to the total amount of the toner.

11. The electrophotographic toner according to claim 1, wherein a volume average particle diameter D50v of particles of the toner is in the range of about 3 μm to about 10 μm.

12. The electrophotographic toner according to claim 1, wherein an average circularity of the particles of the color toner is about 0.9 or more.

13. An electrophotographic developer comprising the electrophotographic toner of claim 1.

* * * * *